US012473788B2

(12) United States Patent
Cygan et al.

(10) Patent No.: US 12,473,788 B2
(45) Date of Patent: Nov. 18, 2025

(54) DOWNHOLE TOOL FOR AUTOMATIC TUBULAR CUTTING

(71) Applicant: Schlumberger Technology Corporation, Sugar Land, TX (US)

(72) Inventors: Adam Cygan, Sugar Land, TX (US); David Engel, Larose, LA (US); Joseph Casassa, Sugar Land, TX (US); Michael Vince, Katy, TX (US); Todor Sheiretov, Houston, TX (US); Maxim Klyuzhev, Houston, TX (US); Juan Jose Jaramillo, Stonehouse (GB); Benjamin Jean Yvon Durand, Houston, TX (US); Maxim Gurevich, Palo Alto, CA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/725,343

(22) PCT Filed: Mar. 9, 2023

(86) PCT No.: PCT/US2023/014873
§ 371 (c)(1),
(2) Date: Jun. 28, 2024

(87) PCT Pub. No.: WO2023/172666
PCT Pub. Date: Sep. 14, 2023

(65) Prior Publication Data

US 2025/0075579 A1 Mar. 6, 2025

Related U.S. Application Data

(60) Provisional application No. 63/269,083, filed on Mar. 9, 2022.

(51) Int. Cl.
*E21B 29/00* (2006.01)
*E21B 23/01* (2006.01)

(52) U.S. Cl.
CPC ..... *E21B 29/005* (2013.01); *E21B 23/01* (2013.01); *E21B 29/007* (2013.01)

(58) Field of Classification Search
CPC ..... E21B 29/05; E21B 23/01; E21B 29/005; E21B 10/26; E21B 29/007
See application file for complete search history.

(56) References Cited

U.S. PATENT DOCUMENTS 9,353,589 B2 * 5/2016 Hekelaar ..... E21B 23/006
2010/0258289 A1 * 10/2010 Lynde ..... E21B 37/02 166/55.7

(Continued)

FOREIGN PATENT DOCUMENTS

WO 2013067263 A2 5/2013
WO 2020161227 A1 8/2020

OTHER PUBLICATIONS

Search Report and Written Opinion of International Patent Application No. PCT/US2023/014873 dated Jun. 29, 2023, 10 pages.

(Continued)

*Primary Examiner* — Yong-Suk (Philip) Ro
(74) *Attorney, Agent, or Firm* — Jeffrey D. Frantz

(57) ABSTRACT

Systems and methods for downhole tubular cutting applications can include a cutting tool that with a cutting head, an anchor module, and a hydraulic module that actuates both. Arms of the anchor module open to an inner surface of a tube prior to blades of the cutting head opening to the inner surface. The blades can be operated by a piston. The piston can include a detent that travels across an actuation profile. This can allow a processor to track the cutting position. The (Continued)

processor can adjust the rotational speed of the blades based on feedback from the system.

14 Claims, 13 Drawing Sheets

(56) References Cited

U.S. PATENT DOCUMENTS

| | | | | |
|---|---|---|---|---|
| 2014/0124191 | A1 | 5/2014 | Hallundbæk | |
| 2016/0319619 | A1* | 11/2016 | Hekelaar | E21B 34/10 |
| 2020/0056450 | A1 | 2/2020 | Duthie | |
| 2021/0254422 | A1 | 8/2021 | Sheiretov | |

OTHER PUBLICATIONS

International Preliminary Report on Patentability of International Patent Application No. PCT/US2023/014873 dated Sep. 19, 2024, 7 pages.

* cited by examiner

DOWNHOLE TOOL FOR AUTOMATIC TUBULAR CUTTING

CROSS REFERENCE TO RELATED APPLICATIONS

This application is a national stage entry under 35 U.S.C. § 371 of International Application No. PCT/US2023/014873, filed Mar. 9, 2023, which claims the benefit of U.S. Provisional Patent Application No. 63/269,083, filed Mar. 9, 2022, which is hereby incorporated by reference in its entirety.

BACKGROUND

Various downhole mechanical service tools are used for performing operations within a wellbore. The wellbore wall or a casing may require operation for a wide variety of reasons. These operations can be performed with a mechanical tubing service tool. The operations can be remedial actions used for completions or other tubular cuts contingencies and challenges arise. These tools can be used in a wireline intervention system, such as for cutting production tubing, cutting tubing during well abandonment, with cut to release packers, on drill pipe, and to free a stuck pipe.

However, there is a constant desire for more accurate cuts and efficient cuts. This ongoing problem can be addressed by both improved cutting tools and by improved methods of controlling or automating those cutting tools. Because it can be very difficult and costly to fix mistakes deep in a wellbore, new tools and methods are needed to ensure efficient and successful tubular cuts occur. Because each downhole environment is unique, tools that provide flexibility to those different environments are needed. Additionally, new methods of monitoring the cuts and quickly reacting to changes are needed.

SUMMARY

The examples described herein address a tubing cutter and methods for using the tubing cutter for downhole cutting operations. The tubing cutter can be used in a wireline intervention system, for use, generally, on production tubing or well abandonment, cut-to-release packers, drill pipe, in the case of stuck pipe. Terms such as "tubing cutter," "cutting tool," and "cutting assembly" are used interchangeably.

The tubing cutter can be an assembly of modules that couple together and are lowered into the downhole environment, such as on a wireline. The tubing cutter can include a rotating member capable of spinning with an orientation coincident to the axis of the tubing, an actuation mechanism, a piston, pin slots, an active anchor, a telemetry module, a power cartridge, a compensator module, a hydraulic pump module, a rotary milling module, and a cutting head. The rotating member can contain a plurality of cutting elements that are capable of being forced outward. The tubing cutter assembly could also include an active stabilizer or active centralizer.

In one embodiment, the tubing cutter assembly includes cutting elements with self-centralizing features to either supplement or obviate the need for a stabilizer or centralizer. In another embodiment, the tubing cutter assembly includes a high force anchor element above the rotating member. A single high-pressure hydraulic line can be shared between the cutting elements and the anchor to actuate the cutting elements and the anchor.

In another embodiment a cutting operation can be performed. The cutting operation can include deploying the cable to a target depth. An operator inputs control parameters, for example a torque setpoint, a torque ramp rate, or a cutter rotational speed. A cutting process can be executed by a processor, which determines if the cutter is engaged with the tubing. Then the cutting operation commences. The processor can execute instructions stored on a non-transitory, computer-readable medium.

In another embodiment, the system assesses the standard deviation of the torque in relation to the torque setpoint input and reduces the torque setpoint and/or rotational speed in the case of deviation above a threshold. The system can increase the torque setpoint and/or rotational speed in the case of deviation below another threshold. The system can adjust the hydraulic pressure to reach the torque setpoint based on the torque feedback received from a downhole sensor. The cutting operation stops once the piston engages the pin.

The tubing cutter tool can be comprised of several modules. This can include a telemetry module, a power cartridge, a compensator module (which can act as a hydraulic oil reservoir), a hydraulic pump module, an anchor module, a rotary module, and a cutting head module. Automated software running on a processor can be used to monitor and control the cutting process. The processor can be located on the downhole cutting tool or can reside outside of the wellbore, such as on a personal computer, and receive information from the telemetry module of the cutting tool. The software can use torque feedback to adjust the rotational speed and system pressure to optimize cutting performance. The software can cause the processor to target a specific torque. That specific torque can change over the course of the cut to reflect different cut progress and conditions. The processor can then adjust rotational speed and system pressure to achieve the torque. For example, when cutting, if torque begins to spike suddenly, the system can decrease cutter rotational speed and dither the hydraulic module solenoid to drop system pressure and monitor the corresponding torque response. As the torque drops back below the target, pressure and rotational speed are increased to increase the torque.

The software and processor can also incorporate machine learning to adjust how the tool attempts to apply more pressure. For example, the tool can apply more pressure to the cut until detecting a detrimental change in torque. A detrimental change could be detected based on instability. Upon making that detection, the processor can respond by dropping pressure. The same can be done for rotational speed. When cutting normally, if there is a sudden change in cutting efficiency, the tool can again attempt to change speed and/or pressure to improve efficiency.

Adjusting the torque and blade speed in this manner can have several advantages. This can extend the life of cutting tools by preventing over torque and stalling. Dropping the system pressure and rotational speed of the cutters generally extends tool life. This method also reduces overall cutting time and increases operational efficiency.

The likelihood of operational success increases because the cutting is optimized to the specific material being cut. For example, the user can input what material is being cut, and the processor can provide recommendations for how to set up the cutting knives. For example, a graphical user interface ("GUI") can indicate what material indexable inserts to use and what size knife to use.

Additionally, pressure and torque feedback allow for monitoring the state of the cut, and particularly depth of penetration. Depth of cut can be gleaned from the change in pressure with change in hydraulic fluid flow. At a certain point in the cut, an expected response between pump rate and pressure change is expected. This translates into a penetration rate and may be used to judge penetration amount. In one example, a detent (e.g., collet) on the hydraulic piston of the cutting tool travels across an actuation profile (such as recesses) and provides a pressure pulse when doing so. As the piston travels, pressure will need to be increased to overcome the actuation profile, and as it passes over, the pressure will drop. This results in a pressure signature that can be used to track cutting progress (specifically, piston and knife travel).

The methods herein also reduce operator error since torque will algorithmically automatically adjust. This also means reaction time to unforeseen changes in the performance is greatly reduced. Based on cutting pressure, torque reading and pump rate, the end of the cut can be determined, even while cutting in compression.

It is understood that the steps of the cutting can happen sequentially. However, the introduction of measurements and evaluation throughout the proposed invention can enable further control opportunities. For example, the system can control parts of or the entire bottomhole assembly. The additional control can allow the system to optimize the utilization of the bottomhole assembly to improve efficiency and effectiveness of the operation. The method also paves the way to new execution workflows that may not necessarily be sequential. For instance, one may decide to repeat one or a combination of steps based on the results of an evaluation during the operation. In such a case, the bottomhole assembly can selectively actuate parts in order to enable or disable at will the different applications contained in this invention, such as perforating, cutting, high-pressure jetting, cementing, and logging. Consequently, the aforementioned system may contain selective actuation, fully compatible with the telemetry and power delivery systems.

It is to be understood that both the foregoing general description and the following detailed description are exemplary and explanatory only and are not restrictive of the embodiments, as claimed.

BRIEF DESCRIPTION OF THE DRAWINGS

The accompanying drawings, which are incorporated in and constitute a part of this disclosure, illustrate various embodiments and aspects of the present invention. In the drawings.

DESCRIPTION OF THE EXAMPLES

Reference will now be made in detail to the present exemplary examples, including examples illustrated in the accompanying drawings. Wherever possible, the same reference numbers will be used throughout the drawings to refer to the same or like parts. The described examples are non-limiting.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

An example system can be used to make tubing cuts in a downhole environment. One method is to have a rotating member that spins with an orientation coincident to the axis of the tubing. This rotating member can contain a plurality of cutting elements that are forced outward by an actuation mechanism connected to a pressurized piston and gradually expand radially as material is cut away until the entire tubing is parted through. To accomplish this, there is generally a near bit active stabilizer or active centralizer to ensure that the cutting head is centralized and that the force of the cutting elements is relatively constant along the circumference even when cutting horizontally. The method can be performed with either an active stabilizer or centralizer as well as a method without an active stabilizer or centralizer that includes centralization features on the cutting elements themselves to ensure that a complete cut is finished without the need for a separate centralizing element.

Figure 1:
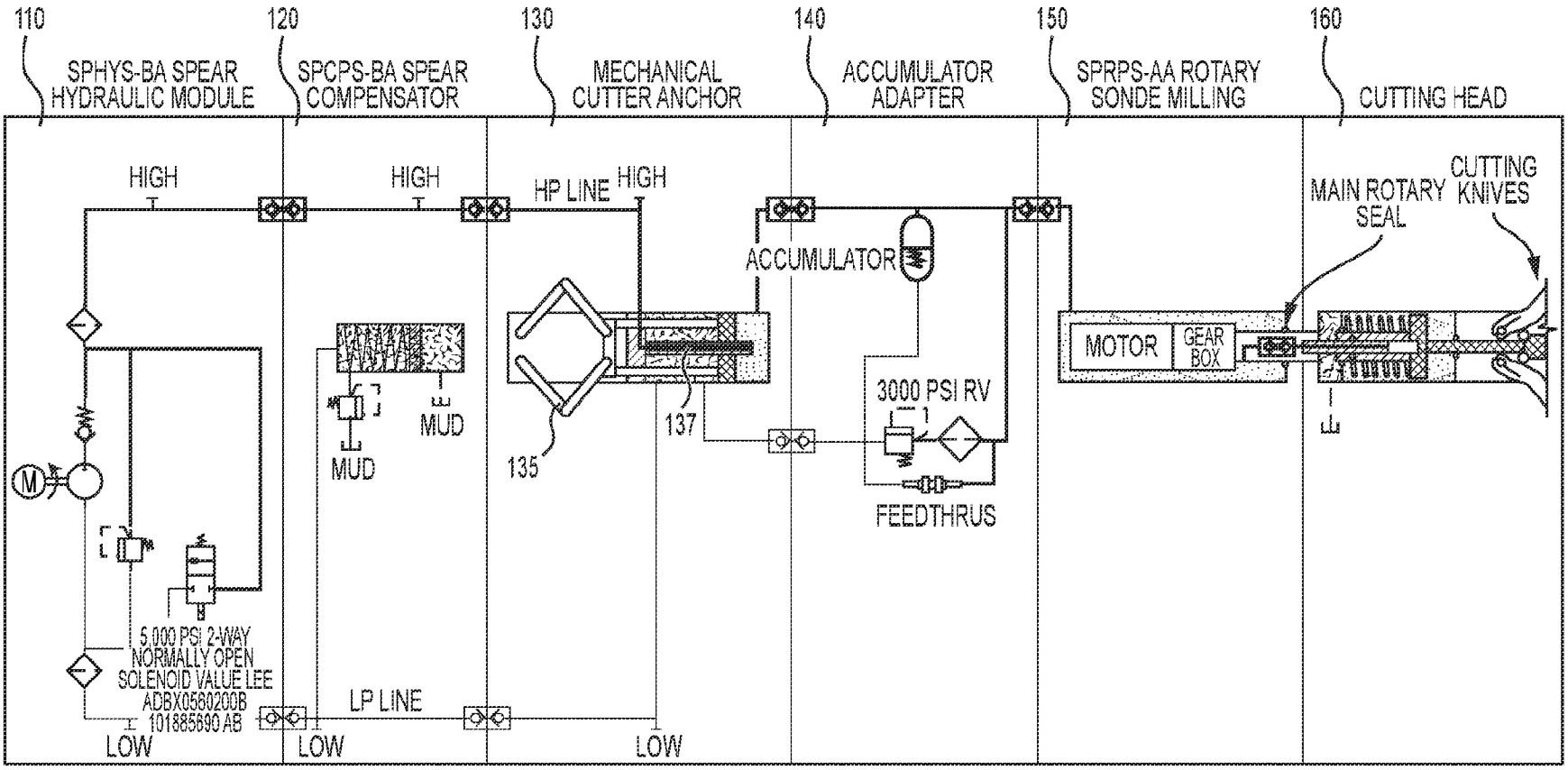
FIG. 1 is an example schematic of a tubing cutter system and flow lines.

FIG. 1 is an example schematic of a modular cutting tool for making downhole tubing cuts, also referred to as a "tubing cutter tool." The tubing cutter tool can be comprised of several modules 110, 120, 130, 140, 150, 160. These modules can fit together and be lowered into the borehole for cutting operations. The hydraulic module 110 can supply hydraulic fluid to the anchor module 130 and to the rotary module 150 to operate the cutting head module 160.

To simplify hydraulics, the pressure to the anchor module 130 and the cutting head 160 (via rotary module 150) can be coupled. The timing of the anchor arm 135 and cutting knife extension can be driven by biased piston diameters and retraction springs in both modules 130, 160.

The cutting tool can perform cuts as follows. First, by pressuring the system (hydraulically), anchor arms 135 will extend first due to larger Piston area 137 and smaller retracting spring rate than that of the cutting head module 160. Next, the processor can stop pressurizing upon indication of initial Anchor Set. Then, the processor can commence slow reverse rotation of the cutting head 160 and extend cutting knives until an indication of full extension is achieved. This can be indicated, for example, via a small pressure change. Reverse rotating is conducted to prevent knife stick that can prevent preliminary centralization of the tool. Next, the processor can dither pressure and cease reverse rotation. Then forward rotation can commence, with a gradually increasing pressure until cut is complete.

The hydraulic module 110 can control and regulate the flow of hydraulic fluid in the cutting process. It can be used to control the speed and force of the cutting tool as it cuts through different types of tubing, rock, or sediment. In one example, the hydraulic module 110 works by regulating the flow rate and pressure of the hydraulic fluid that powers the cutting equipment. This can help to maintain a consistent level of force and speed on the cutting tool, which is important for ensuring efficient and effective cutting operations, including uniform cuts.

In addition to controlling the flow of hydraulic fluid, the hydraulic module 110 may also include other components such as sensors, valves, and actuators that help to monitor and adjust the cutting or anchoring process. For example, module 110 may include sensors that detect changes in the resistance of the hardness of the material being cut. The processor can adjust the flow of hydraulic fluid accordingly to maintain the desired level of force on the cutting tool.

Overall, the hydraulic module 110 can help ensure safe, efficient, and effective downhole cutting operations by regulating the flow of hydraulic fluid to the cutting equipment and helping to maintain consistent levels of force and speed on the cutting tool.

A hydraulic compensator module 120 can be used to maintain constant pressure on the cutting tool or bit. The hydraulic compensator module 120 can automatically adjust the fluid flow rate and pressure to compensate for changes in the load on the rotary module 150 or cutting head module 160 as it encounters different formations and materials in the wellbore.

During drilling operations, the cutting head module 160 is subjected to varying levels of resistance as it cuts through different types of tubing, concrete, rock, or sediment. If the pressure on the cutting tool is not maintained at a constant level, it can cause the tool to make unwanted cuts. This can lead to an unstable situation, such as potentially damaging the drilling equipment, tubes that are meant to be left intact, or it can even lead to collapse of the wellbore.

The hydraulic compensator module 120 can help prevent these issues by continuously monitoring the pressure on the cutting head module 160 and adjusting the flow rate and pressure of the drilling fluid as necessary to maintain a constant load on the tool. This allows for smoother and more efficient drilling operations while also helping to protect the integrity of the wellbore.

An anchor module 130 can hold the cutting tool in place while the cutting head performs a cut. In one example, hydraulic fluid is supplied to the anchor module 130 to cause anchor arms 135 to extend outward. The anchor arms 135 can be scissor-style, such that the elbow protrudes out towards the inner wall of the tube being cut. The anchor arms 135 can apply pressure on opposing points of the inner wall, helping to centralize and hold the cutting tool in place during cutting operations.

In one example, a cutter actuation mechanism is activated and engages a piston 137 to extend the anchor arms 135 and then open the cutter elements. Anchor arms 135 can extend first due to a larger piston 137 area and smaller retracting spring rate than that of the cutting head 160. In other words, the retracting spring of the cutting head can be stronger than that of the anchor module 130. Pressurizing can cease upon indication of initial anchor set, which can be detected by the processor based on piston 137 position and hydraulic pressure. The rotating member 150 then rotates the cutting elements (e.g., knives) of the cutting head 160.

A processor in one of the modules can execute instructions to monitor the cutter elements opening. As the cutter elements spin, the sensors can measure the torque and send that information back to the processor. The processor can then determine whether the cutter is touching the tubing based on the torque response. If so, the algorithm being run by the processor can end. If there is an increase in torque from the baseline level of torque measured at the start of the engage tubing process then the algorithm determines the tubing is engaged.

The processor can execute automated software, which can be embedded in the cutting system. The software allows the processor to monitor and control the cutting process in an example. For example, the processor can use torque feedback to adjust the rotational speed. Likewise, the processor can adjust system pressure to optimize cutting performance. The algorithm can target a specific torque for the stage of the cut. The specific torque can change over the course of the cut. Then the processor can adjust rotational speed and system pressure to achieve that specific torque. For example, when cutting, if torque begins to spike suddenly, the system can decrease cutter rotational speed and dither the hydraulic module solenoid to drop system pressure. The processor can monitor the corresponding torque response. As the torque drops back below the target, pressure and rotational speed are increased to increase the torque. Although the processor is not illustrated in FIG. 1, it can reside on any of the modules or externally. The cutter tool can communicate externally using a telemetry module, in one example, which will be discussed later with respect to FIG. 3.

An accumulator module 140 can include a large accumulator volume to allow linkage to expand and remain at high pressure if the anchor arms 135 slip or if anchoring is no longer centralized.

The tubing cutter assembly can include a rotating member 150 capable of spinning with an orientation coincident to the axis of the tubing. The modular cutting tool can be used on a variety of materials and geometries (such as circular, oblong, and non-continuous). Typically, this can include features such as cutting umbilical lines for completions or diametrical controls to cut only one particular section.

The rotating member 150 can further include an actuation mechanism and a piston. When the piston is actuated with hydraulic force, a plurality of cutting elements is forced outward (e.g., such that cutting knives open). Stops (i.e., bumpers) on the knife assembly can prevent cutting past a certain diameter and damaging casing. These bumpers can be adjustable at the surface. Additionally, a pin can be installed to prevent the piston of the cutting head module 160 from traveling past a certain point.

Figure 2:
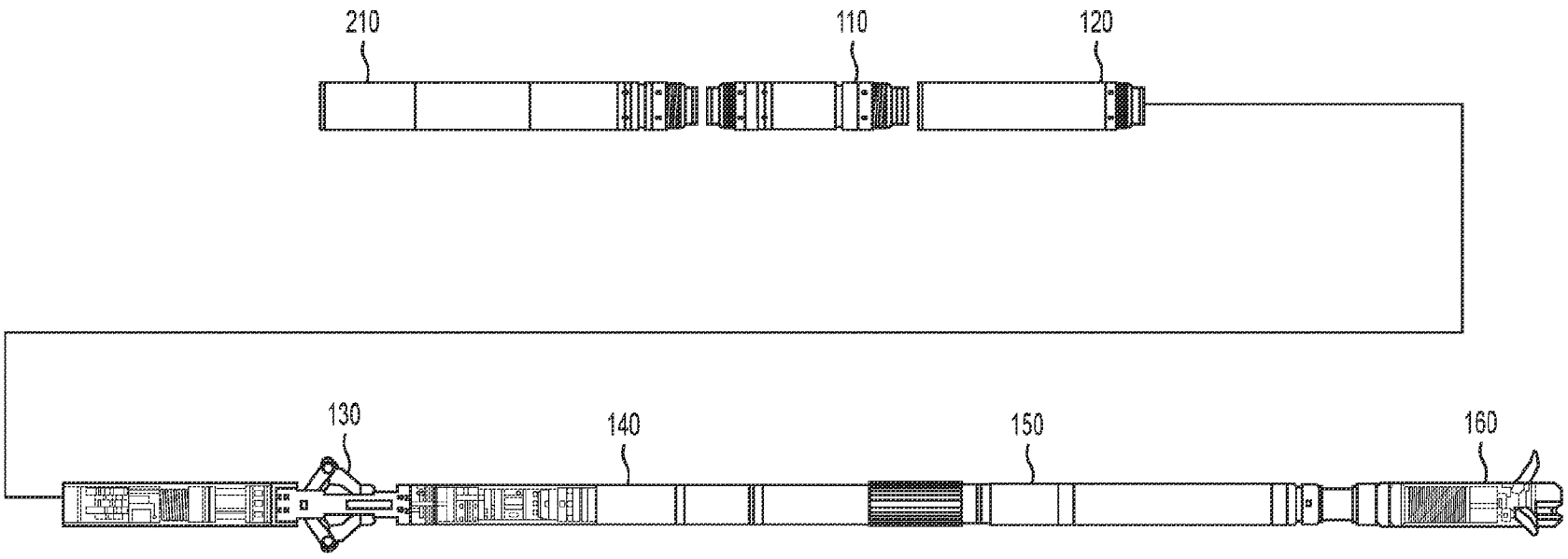
FIG. 2 is an example illustration of a side view of a tubing cutter system.

FIG. 2 is an example illustration of a side view of a tubing cutter system. Many of the same modules 110, 102, 130, 140, 150, 160 are present from those of FIG. 1. In addition, a power cartridge 210 is modularly added to the cutting tool. The power cartridge 210 can be a battery or a power transformer that supplies power to the hydraulic module 110 and other modules of the cutting tool.

Figure 3:
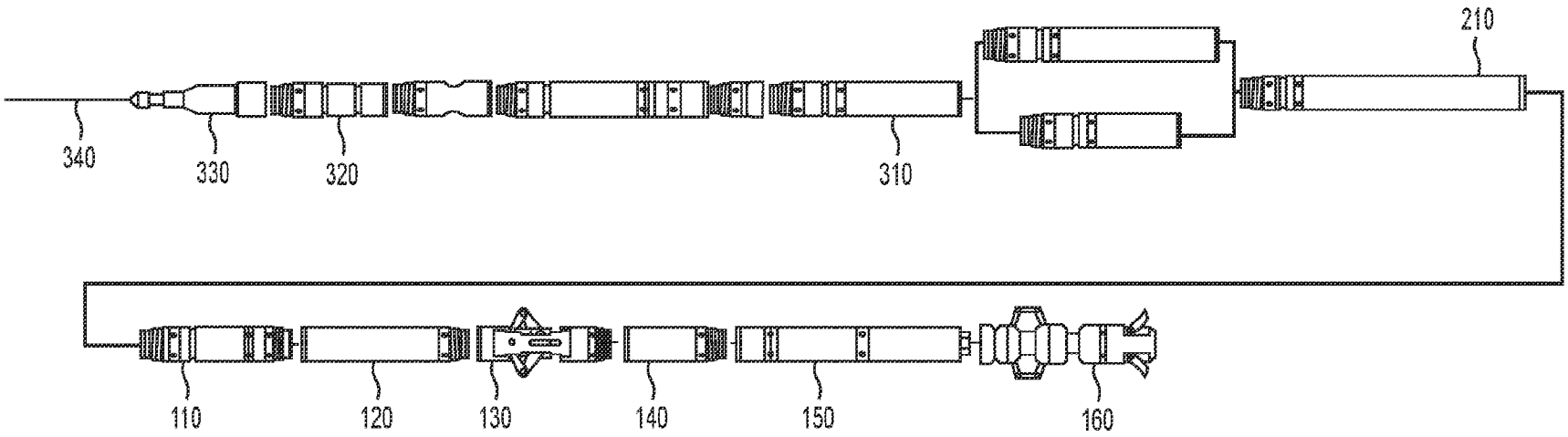
FIG. 3 is an example illustration of a side view of a tubing cutter system with an integrated anchor system.

FIG. 3 is an example illustration of a side view of a tubing cutter system with an integrated anchor system. A cable 340 can be used to lower the modular cutting tool into the downhole. A head 330 can connect to the cable and be coupled to a swivel 320.

A telemetry cartridge 310 can be used to send and receive data with an external computer in an example. The data can include hydraulic pressure readings and signatures, piston travel distances, torque measurements, and other information used by the processor to automate the cutting process.

The processor is not illustrated in FIG. 1 or 3 but can reside on one of the modules or externally at the surface. But automating the cuts based on hydraulic pressure and piston travel readings, the system can extend the life of the cutters and tool. For example, by having the controls determine when the torque is increasing above a desired level and responding by dropping the system pressure and rotational speed of the cutters, this prevents mechanical damage and stalling. Likewise, the automation decreases the time it takes to make a cut.

Operational success also increases. The system can receive user input regarding the different materials, tubular sizes and thicknesses for the particular downhole environment where the cuts will be made. The processor can then target specific torque measurements based on expected materials and thickness.

Telemetry also allows the processor to determine the state of the cut. This allows for obtaining the desired depth of penetration in one pass, in an example. The state of the cut likewise can display on a GUI for monitoring by a user. This all decreases the chances of operator error in the cutting operation.

The system can also use telemetry to react to unforeseen changes in performance and to ensure equipment is operational and in the correct configuration.

In one embodiment, the rotary module 150 is filled with compensating hydraulic fluid for the purposes of (1) Cooling, (2) Lubrication, (3) Internal Pressure Compensation to that of the downhole environment. Compensating oil pressure in the rotary module is used to pressurize the piston to actuate the cutting elements. The fluid pressure is used as the actuation medium for the cutting head piston, which drives the tubing cutter arms to the open position.

In one or more embodiments a common hydraulic pressure is used for both engaging the anchor and opening the cutting element. The pressure line for the anchor and the cutting elements is coupled to simplify the hydraulics of the system. It is desired that the anchor arms open first. To achieve this order of opening, the anchor includes stronger retraction springs than used by the cutting elements and/or there is a difference in piston diameter.

In one or more embodiments, the entire rotary module internal volume is pressurized against the wellbore anulus by pumping hydraulic fluid across a pressure barrier located between the rotary module and section of the tool that houses the hydraulic pump and the oil reservoir and pressure compensator.

The tubing cutter assembly can include an accumulator adaptor 140. A large accumulator volume is desired to allow the anchor linkage to expand and remain at high pressure if anchor slips while anchored un-centralized.

Figure 4:
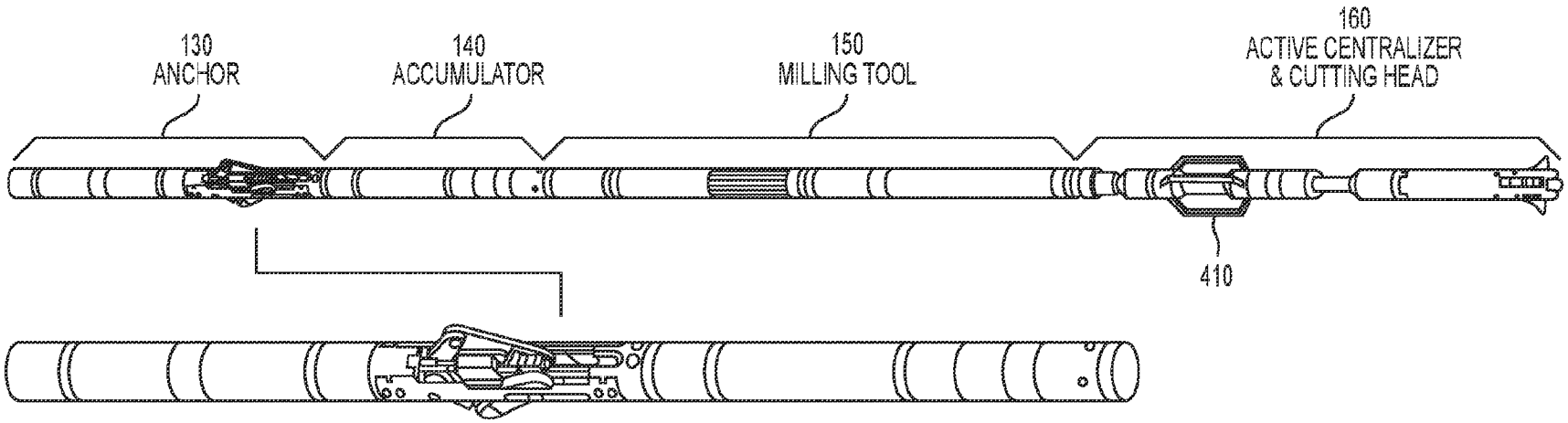
FIG. 4 is an example illustration of a side view of a tubing cutter system with centralizer.

FIG. 4 is an example illustration of a side view of a downhole cutting tool with a centralizer 410. In a downhole cutting operation, the centralizer 410 can keep the cutting tool centered in the wellbore during the cutting process. The centralizer 410 can be mounted on the cutting tool and consists of one or more arms or fins that extend outward from the tool body.

The purpose of the centralizer 410 is to prevent the cutting tool from becoming lodged or stuck in the wellbore due to uneven pressure or obstructions. By keeping the tool centered in the wellbore, the centralizer 410 allows for a more even and efficient cutting process, reducing the risk of damage to the tool and improving the quality of the cut.

Figure 5:
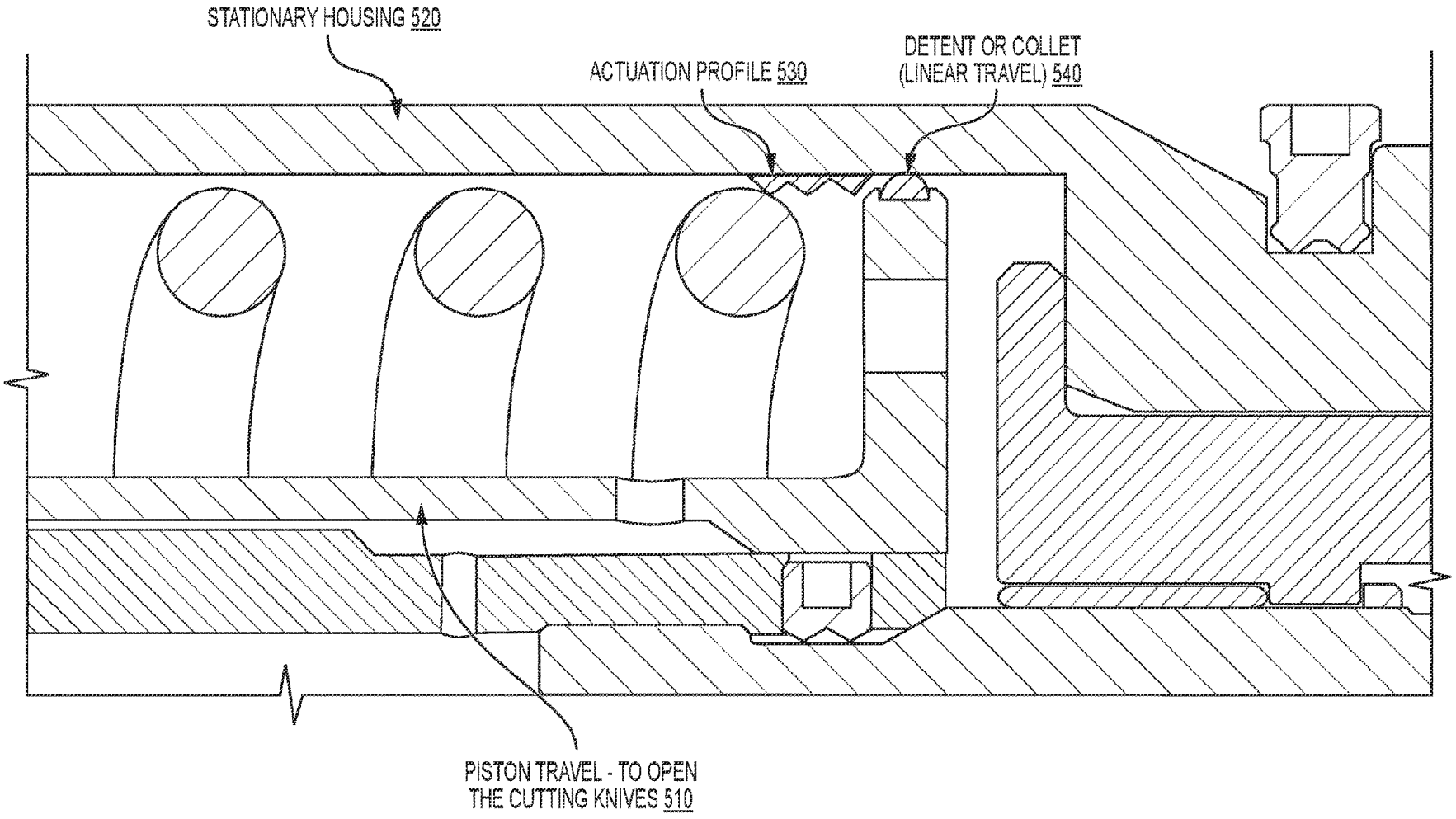
FIG. 5 is an example illustration of a detent on the housing of a tubing cutter system.

FIG. 5 is an example illustration of a detent 540 (i.e., collet) that can produce a pressure signature as it travels across an actuation profile 530 on the inner housing 520 of a tubing cutter system. The detent 540 can be part of the piston 510 in the cutting head module 160.

As the piston 510 travels, pressure will need to increase to overcome the actuation profile 530. As the detent 540 passes over ridges in the profile 530, the pressure will drop. This results in a pressure signature that can be used to track cutting progress (e.g., piston and knife travel). This telemetry data can be reported to the processor and used to automate the cut.

Figure 6:
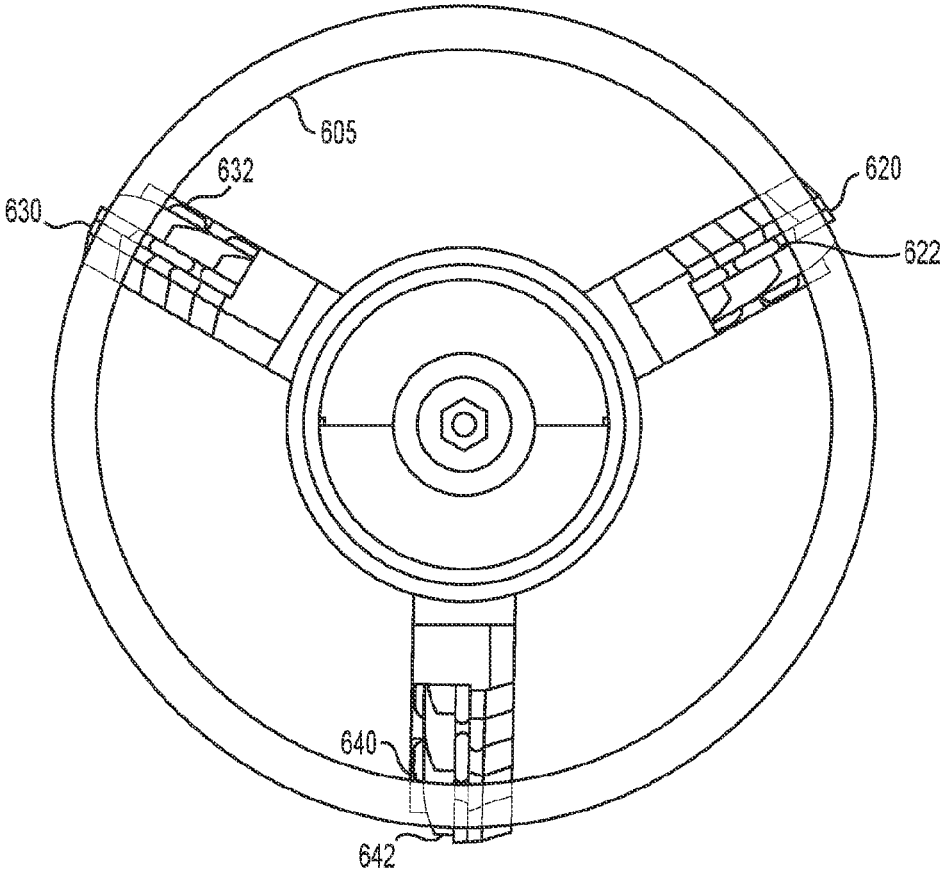
FIG. 6 is an example illustration of an axial view of a self-centralizing knife with a bumper insert engaging the tubing.

FIG. 6 is an example illustration of an axial view of a self-centralizing knife with a bumper insert engaging the tubing. The cutting knives used in the tubing cutter, can utilize off the shelf cutting inserts (such as those used in standard metal cutting on an industrial lathe or mill) for reduced cost of replacement, and to take advantage of the advanced materials and qualities (chipbreakers, relief angles, rake angles) present on these inserts.

The knives 620, 630, 640 themselves can include a centralizing feature in the form of non-cutting hard (e.g., carbide or similar) inserts (i.e., bumpers) 622, 632, 642 that can be placed on the knife in a location to control the depth of cut. This can be particularly useful when the cutting tool has no centralizing feature but is also useful even when a centralizer exists. These bumpers 622, 632, 642 are interchangeable between cutters 620, 630, 640.

For example, if the cutter is horizontal, the force on the downward portion of the cut will always be greater than at the upper end of the cut (due to gravity). Therefore, the tool will likely cut more quickly through the bottom, and will continue to progress unabated, which may lead to inability to cut through completely on the top end, and also potentially damage items behind the tubing. However, with a noncutting hard insert (bumper) 622, 632, 642 located at an appropriate position on the cutting knife 620, 630, 640, based on the outer diameter and thickness of the tubing being cut, on the lower end of the cut, the tubing 605 will start to engage the bumper on the knife 620, 630, 640. This can prevent further cutting progress in that location. This solution also provides a solid reaction force for the cutters to continue to cut through the tubing in the remaining locations along the rest of the circumference of the tubing.

At the end of the cut, all of the bumpers 622, 632, 642 will engage the tubing 605, and prevent further egress of the knives, to prevent damage to items behind the tubing, it also gives an indication via change in pressure behavior and torque behavior that the cut is complete. The knives are self-centralizing.

A point in time when all the bumpers 622, 632, 642 engage the tubing 605 can also be a way to communicate to the system that cutting has stopped.

In the example of FIG. 6, bumper 640 is engaged with tubing 605, preventing further cutting of knife 642, whereas bumpers 622 and 632 are not engaged, allowing knives 620 and 630 to continue cutting. This can result in a more uniform cut.

Figure 7:
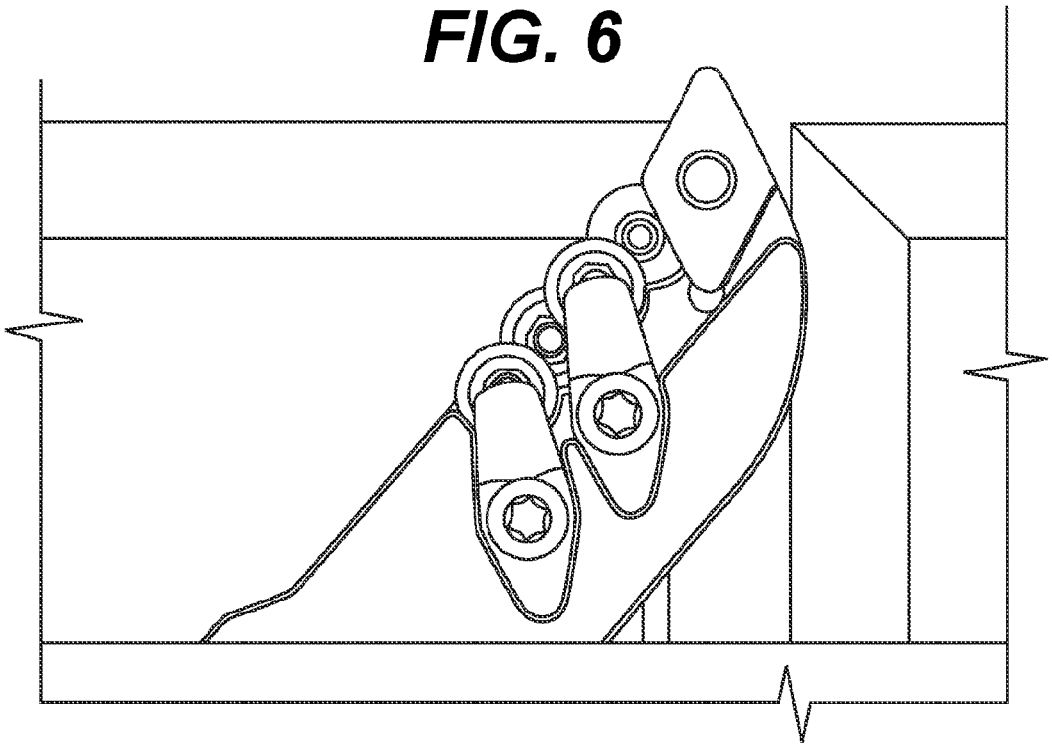
FIG. 7 is an example illustration of a side view of a cutting element.
Figure 8A:
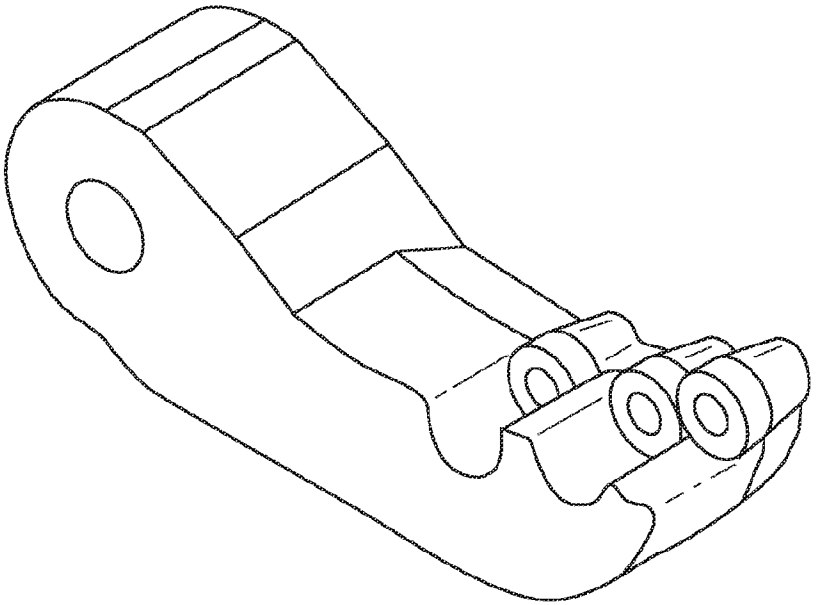
FIG. 8A is an example illustration of a perspective view of a cutting element with staggered inserts.
Figure 8B:
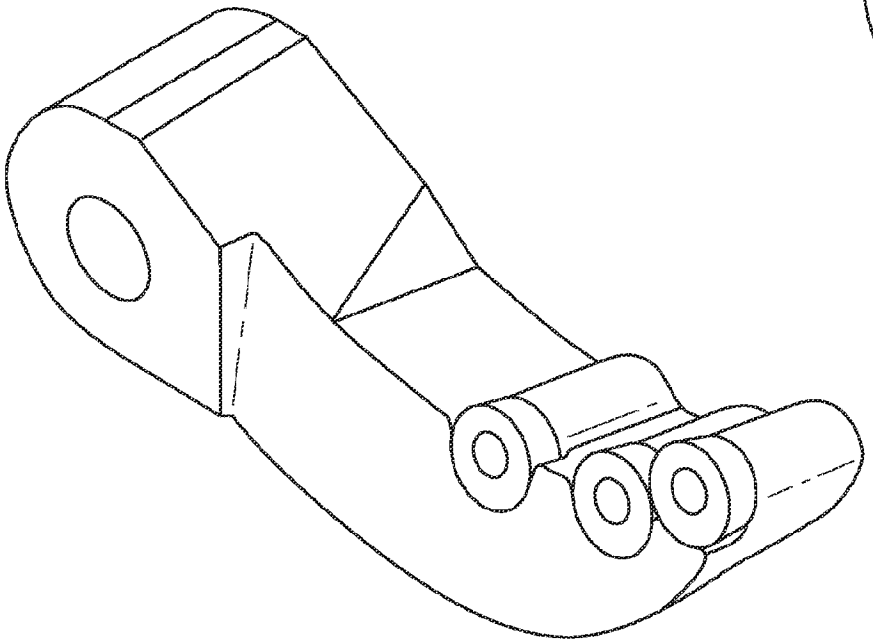
FIG. 8B is an example illustration of a perspective view of a cutting element with staggered inserts.

FIG. 7 is an example illustration of a side view of a cutting element (in this case, a knife). The cutters can be inserts that are oriented differently according to the cuts needed and the materials being cut. For example, the cutter inserts can be staggered on the knife. FIG. 8A is an example illustration of a perspective view of a cutting element with staggered inserts. FIG. 8B is an example illustration of a perspective view of a cutting element with staggered inserts.

With staggered insert locations, the cutters do not have identical insert arrangement to increase the force on individual cutters. This can reduce overall torque needed for the cut.

Figure 9:
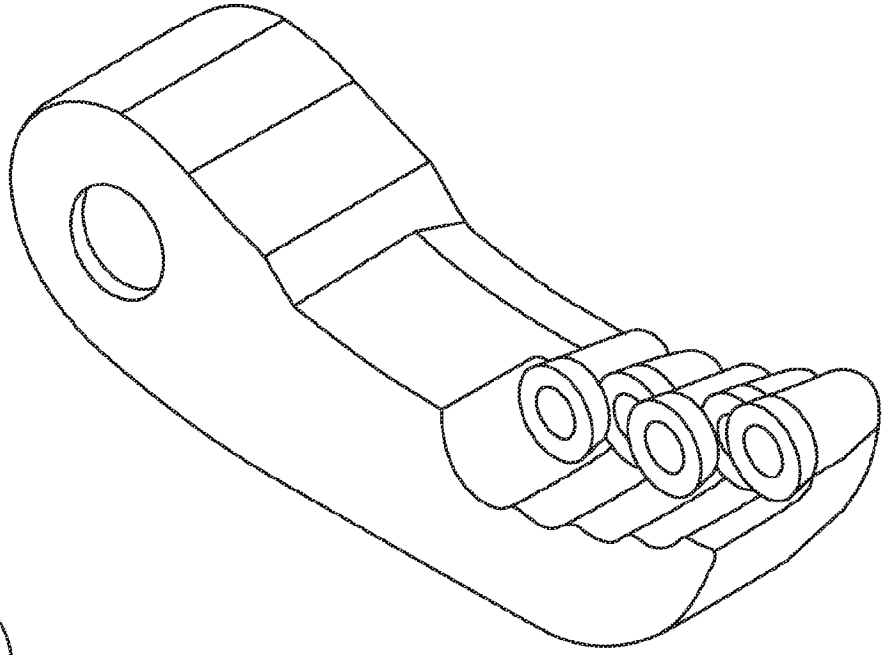
FIG. 9 is an example illustration of a perspective view of a cutting element with overlapping inserts.
Figure 11:
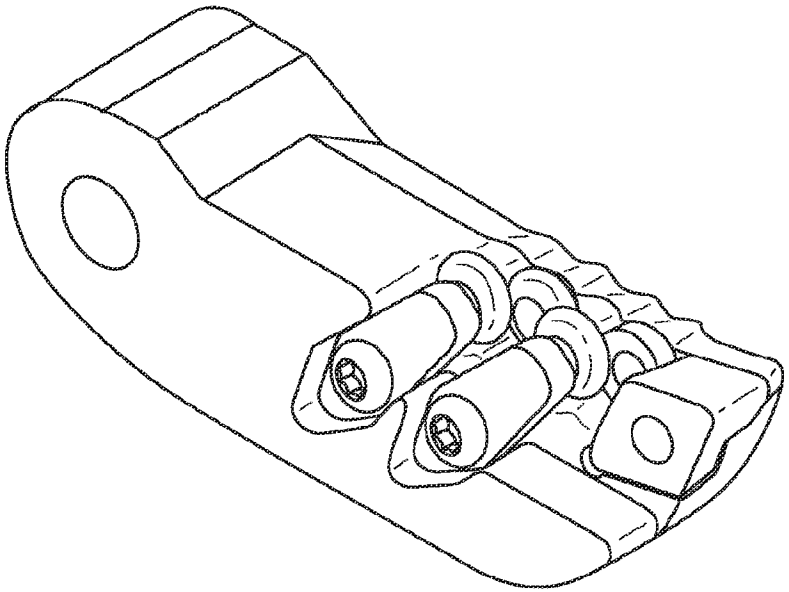
FIG. 11 is an example illustration of a perspective view of a cutting element with clamps.
Figure 10:
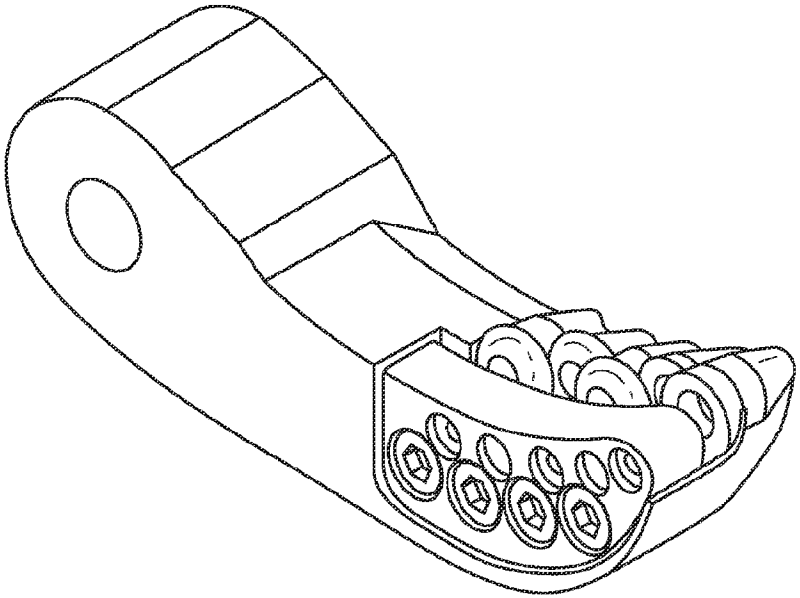
FIG. 10 is an example illustration of a perspective view of a cutting element with plate with set screw.

Alternately, overlapping cutting inserts can reduce the contact on individual inserts to reduce stress on inserts (identical knives). Examples of overlapping cutting inserts are shown in FIGS. 9, 10, and 11. FIG. 9 is an example illustration of a perspective view of a cutting element with overlapping inserts. FIG. 10 is an example illustration of a perspective view of a cutting element with plate with set screw. FIG. 11 is an example illustration of a perspective view of a cutting element with clamps.

In short, the cutting inserts can be placed in a variety of locations on the knives. The inserts can be in a staggered position as in FIGS. 8A and 8B. This position requires less cutting force. Increasing the force on individual cutters reduces overall torque needed. Overlapping cutting inserts, such as in FIGS. 9, 10, and 11, reduces the contact on individual inserts and reduces stress on inserts. The knife could also have a single insert with a single diamond cutter insert. This arrangement provides more stable torque.

The knives can be embedded with a torsional spring in the cutter to provide a retraction method, since the actuation method only runs as a wheel on cam and cannot provide closing force.

The torsion spring can also keep the debris excluder in place flexibly. This can be important because a fixed position excluder often requires a gap with the knife, whereas a floating excluder allows it to touch the knife and limit debris ingress.

Set screws can be used to hold down the cutting inserts. This allows a single plate, such as in FIG. 10, to cover the plurality of inserts and hold them down with multiple set screws. A user can adjust for the tolerances of the system. An alternate method is to use clamps to provide sufficient force on the back of the insert when there is insufficient shoulder or support from the screw for the insert. This is illustrated in FIG. 11. Another method is to use an intermediate plate to provide support for the inserts, which cannot be integral to the knife because the inserts are installed in a staggered overlapping fashion.

Figure 12:
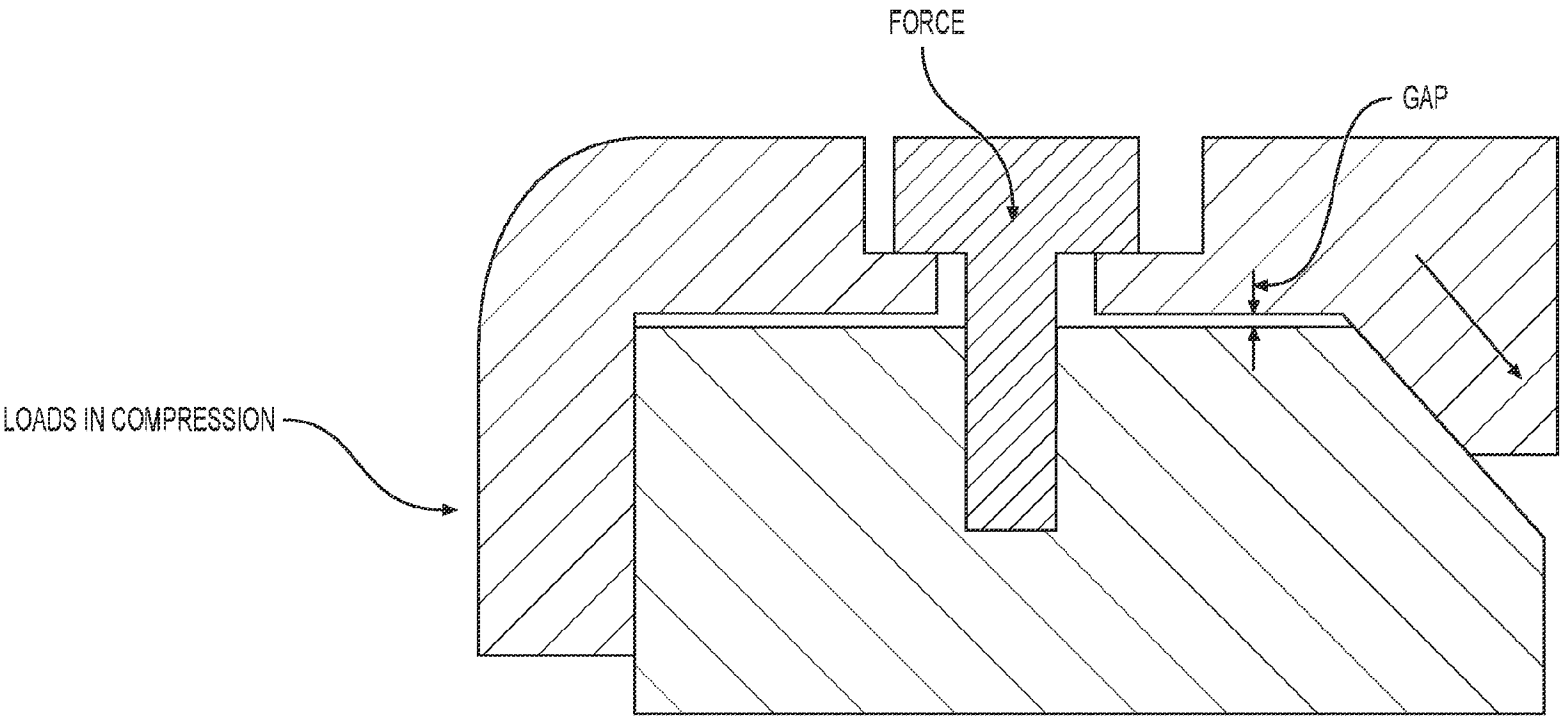
FIG. 12 is an example illustration of a cross-sectional view of an anchor gripping attachment when anchoring against casing.

FIG. 12 is an example illustration of a cross-sectional view of an anchor gripping attachment when anchoring against casing. This anchor can be part of the anchor module 130 and anchor arms 135 above the rotating members 150 included in the tool. The anchor element can alternatively be located below the rotary milling module. In this embodiment, in order to reduce the complexity of the system, a single high-pressure line is shared to actuate the cutting elements and the anchor. This requires a high force anchor, with an embodiment presented here.

Figure 13:
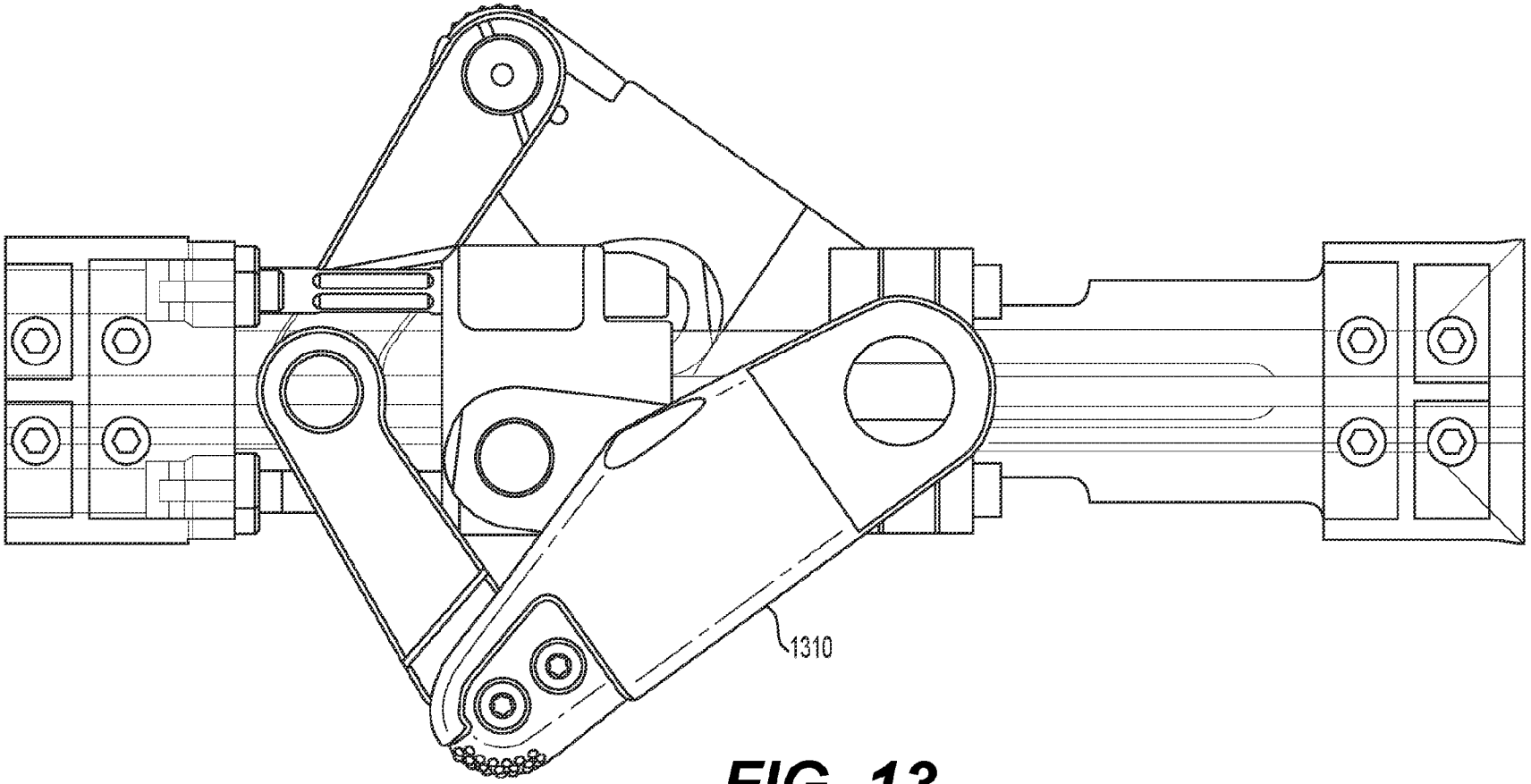
FIG. 13 is an example illustration of a side view of a six-bar linkage anchor.

The anchor design can combine a swing arm linkage (for high initial force along with a high force at large openings) with a combined six-bar linkage system (such as in FIG. 13). This is important because the tubing cutter rotational tool can produce high torque regardless of cutting diameter, therefore it is important that the anchor be able to provide high force at small diameters.

The anchoring grip to casing interaction is shown in FIG. 12. Because the linkage is scissor style, it does not self-centralize. FIG. 12 shows an example design of anchor pads that slide in one direction of rotation and grip in the other direction. This allows the anchor to ride up the casing and centralize more, but still oppose the cutting torque in the opposite direction.

The method of gripper attachment can involve a ramp to allow seat in compression when anchoring against casing.

Figure 14:
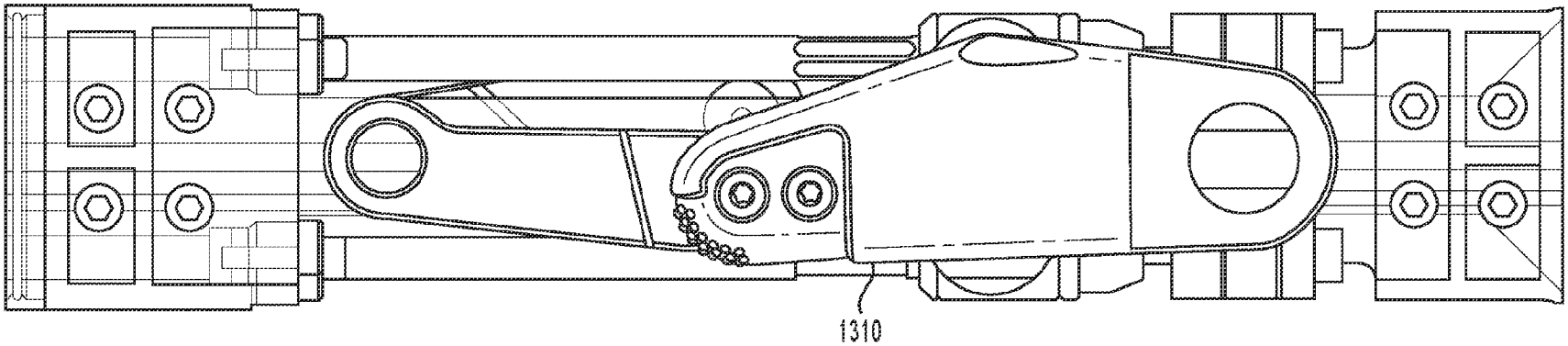
FIG. 14 is an example illustration of a side view of a linkage anchor in the retracted position.

FIG. 13 is an example illustration of a side view of a six-bar linkage anchor. With scissor-style arms 1310 extended. FIG. 14 is an example illustration of a side view of the same linkage anchor in the retracted position, with arms 1310 retracted.

Figure 15:
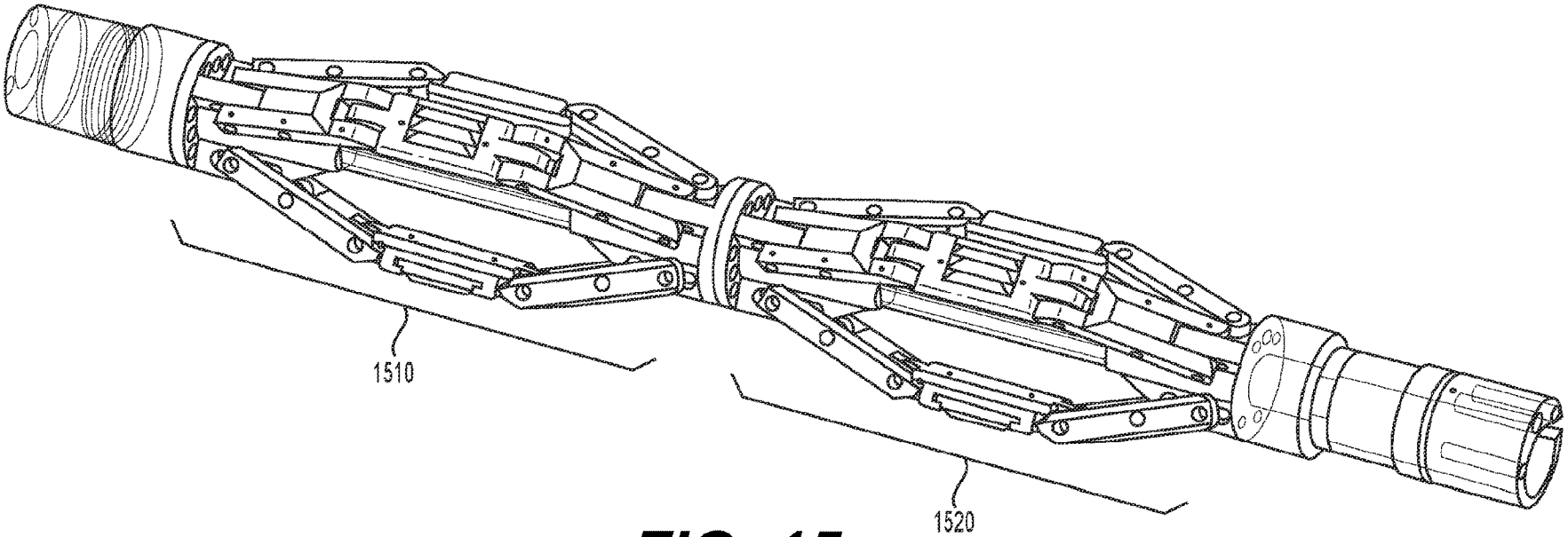
FIG. 15 is an example illustration of a perspective view of an anchor with two sets of three linkage arms.

FIG. 15 is an example illustration of a perspective view of an anchor with two sets 1510, 1520 of three linkage arms. As shown, the anchor element can have two sets of three arms 1510, 1520, centralizing in radial and axial direction from one linkage. The benefit of this design is that it will centralize both radially and axially.

If Necessary, a secondary stabilizer (rotating)/or anchor (stationary, with thru rotating shaft) can be used to provide support for and centralize the anchor.

The cutting system disclosed within can be used with any anchor element described or combination thereof.

In one or more embodiments a cutting operation can be performed. The cutting operation can include deploying the cable to a target depth. An operator inputs control parameters into the control software on the computer running the job at surface from the wireline truck or offshore wireline skid unit, for example a torque setpoint, a torque ramp rate, the type of material being cut, or a cutter rotational speed. An engaging tubing algorithm is initiated to determine if the cutter is engaged with the tubing.

The system is pressurized. The cutter actuation mechanism is activated and engages the piston to extend the anchor arms and then open the cutter elements. Anchor Arms will extend first due to larger Piston area and smaller retracting spring rate than that of the cutting head. Pressurizing ceases upon indication of initial anchor set. The rotating member then rotates the cutter element. The engaging tubing algorithm monitors the cutter elements opening, and as the cutter elements spin the sensors measure the torque and send that information back to the algorithm. The algorithm determines whether the cutter is touching the tubing based on the torque response and ends engaging tubing algorithm. If there is an increase in torque from the baseline level of torque measured at the start of the engage tubing process then the algorithm determines the tubing is engaged.

Then cutting operation commences. Forward rotation of the cutting elements begins, and pressure is gradually increased while cutting. The system assesses the standard deviation of the torque in relation to the initial torque setpoint. The system will adjust the rotation speed and system pressure to reach the torque setpoint based on the torque feedback received from the motor, specifically the current and voltage going through the motor. Based on this, the system can infer the torque. For example, when cutting, if torque begins to spike suddenly, the system will decrease cutter rotational speed and dither the hydraulic module solenoid to drop system pressure and monitor the corresponding torque response. As the torque drops back below the torque setpoint, system pressure and rotational speed are increased to increase the torque.

The optimal torque setpoint can change over the course of cutting. If the standard deviation of torque from the setpoint over a certain length of time is too low, indicative of the cutters rubbing and no cutting, then the system can increase the torque setpoint or rotational speed. If the standard deviation of torque from the setpoint over a certain length of time is too high, indicative of cutting too aggressively, then the system will decrease the torque setpoint or rotational speed to prevent stalling or damage to the cutting inserts or other mechanical components.

The tool can include a plurality of pin slots on the cutting head. The pin slots can be positioned a specified distance apart to account for standard tubular sizes. A stop pin can be inserted on the housing into a pin slot to prevent cutting past a certain diameter to prevent damaging casing. The stops are adjustable at surface by installing a pin that will prevent piston travel past a certain point. The pin is placed in a slot corresponding to the desired diameter that is needed to cut based on the tubing diameter. In operation, when the piston is actuated and engages with the pin, the torque drops, and pressure increases indicate the cut is complete.

The cutting operation stops once the piston engages the pin. Based on cutting pressure, torque reading and pump rate, the end of the cut can also be determined.

By optimizing the torque to be as high as practicable for the system for as long as possible, the cutting time will be reduced. A learning mode can also be included. The tool can attempt to apply more pressure to the cut until it sees a detrimental change in torque—13 for example, instability, and then would respond by dropping pressure. The same can be done for rotational speed. When cutting normally, if there is a sudden change in cutting efficiency, the tool can again attempt to change speed and/or pressure to improve efficiency.

Depth of cut can be gleaned from the change in pressure with change in hydraulic fluid flow. At a certain point in the cut, an expected response between pump rate and pressure change is expected. This translates into a penetration rate and may be used to judge penetration amount.

The parameters input by the operator can be used by the system to recommend how to set up the cutting knives. This can include what material indexable inserts to use, and what size knife to use.

Reverse torque can be used for fishing. Reverse torque breaks a shear pin and reveals a fishing head profile.

The system can equalize pressure prior to cutting. By using a slot cutter or puncher tool to equalize pressure prior to tubing cutting so that the pressure differential across the inside and outside of the tubing is the same (reducing forces on the tubing), the system can make the end of cut easier. The tool is generally less likely to get stuck.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to describe some elements more clearly. Commonly, these terms relate to a reference point at the surface from which drilling operations are initiated as being the top point and the total depth being the lowest point, wherein the well (e.g., wellbore, borehole) is vertical, horizontal or slanted relative to the surface.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

Other embodiments of the invention will be apparent to those skilled in the art from consideration of the specification and practice of the invention disclosed herein. It is understood that the control functionality can be carried out be a processor-enabled device, which can be separate from or part of the slot cutter, depending on the example. Also, the terms slot cutter and cutting device are used interchangeably. It is intended that the specification and examples be considered as exemplary only, with a true scope and spirit of the invention being indicated by the following claims.

What is claimed is:

1. A method for cutting tubing in a wellbore, comprising:

causing anchor arms of an anchor module to extend outward to an inner wall of tubing;

rotating a cutting head with an orientation coincident to an axis of the tubing, wherein the cutting head includes a plurality of cutting elements, wherein the anchor module is positioned above the cutting head instead the wellbore;

forcing the cutting elements outward using an actuation mechanism to form a cut in the tubing, wherein the actuation mechanism is connected to a pressurized piston disposed within a piston housing, wherein the cutting elements gradually expand radially as material of the tubing is cut away;

determining a depth of the cut made by the cutting elements based upon pressure pulses, wherein the pressurized piston includes a radially protruding detent and an inner surface of the piston housing includes an actuation profile including one or more ridges, and wherein the pressure pulses are generated by the detent overcoming the one or more ridges; and adjusting hydraulic pressure to the cutting head based on torque feedback of the cutting elements.

2. The method of claim 1, wherein supplying hydraulic fluid causes the anchor arms to extend outward to the inner wall before the cutting elements reach the inner wall.

3. The method of claim 1, wherein a hydraulic line is shared between the cutting head and the anchor module for actuating both the cutting elements and the anchor arms, and wherein the hydraulic pressure is adjusted based on the torque feedback differing from a target torque.

4. The method of claim 1, further comprising supplying compensating hydraulic fluid from a rotary module to compensate for internal pressure in the wellbore.

5. The method of claim 1, further comprising activating a near bit active stabilizer or a centralizer to centralize the cutting head within the tubing.

6. The method of claim 1, wherein the cutting head includes a bumper on a cutting knife, wherein the bumper engages the tubing to prevent further cutting by the cutting knife.

7. A downhole tool for tubular cutting, comprising:

a cutting head having cutting elements, wherein the cutting head is configured to rotate with an orientation coincident to an axis of tubing, wherein a pressurized piston disposed within a piston housing is movable within the piston housing to cause the cutting elements gradually expand radially as material of the tubing is cut away, wherein the pressurized piston includes a radially protruding detent and an inner surface of the piston housing includes an actuation profile including one or more ridges such that pressure pulses are generated by the detent of the pressurized piston overcoming the one or more ridges as the pressurized piston moves within the piston housing;

an anchor module positioned above the cutting head, wherein the anchor module includes anchor arms that are configured to extend outward to an inner wall of tubing; and a hydraulic module that is configured to supply hydraulic fluid to the cutting head and anchor module, to cause the anchor arms and cutting elements to actuate.

8. The downhole tool of claim 7, wherein supplying the hydraulic fluid causes the anchor arms to extend outward to the inner wall before the cutting elements reach the inner wall.

9. The downhole tool of claim 7, further comprising a hydraulic line that is shared between the cutting head and the anchor module.

10. The downhole tool of claim 7, further comprising a compensator module that is configured to supply compensating hydraulic fluid to a rotary module to compensate for internal pressure in a wellbore.

11. The downhole tool of claim 7, wherein the cutting head includes an active stabilizer or a centralizer configured to centralize the cutting head within the tubing.

12. The downhole tool of claim 7, wherein the cutting elements include a bumper and a cutting knife, wherein the bumper is configured to engage the tubing to prevent further cutting by the cutting knife.

13. The downhole tool of claim 12, wherein the cutting elements include insert locations for multiple bumpers, wherein the insert locations are staggered or overlapped.

14. The downhole tool of claim 7, wherein anchor pads on the cutting head are configured to slide in one direction of rotation but grip in the opposite direction of rotation.

* * * * *